United States Patent [19]

Robbins

[11] Patent Number: 5,075,906

[45] Date of Patent: Dec. 31, 1991

[54] SEAT LIFT

[75] Inventor: Daniel T. Robbins, 368 E. Lombardy La., Banning, Calif. 92220

[73] Assignee: Daniel T. Robbins, Independence, Mo.

[21] Appl. No.: 608,172

[22] Filed: Oct. 31, 1990

[51] Int. Cl.[5] ..... A47K 13/10
[52] U.S. Cl. ..... 4/251
[58] Field of Search ..... 4/251

[56] References Cited

U.S. PATENT DOCUMENTS

| | | | |
|---|---|---|---|
| 765,643 | 7/1904 | Tregoning | 4/251 |
| 1,856.159 | 5/1932 | Grillo et al. | 4/251 |
| 2,954,565 | 10/1960 | Miller | 4/251 |
| 3,055,016 | 9/1962 | Kemp | 4/251 |

FOREIGN PATENT DOCUMENTS

| | | | |
|---|---|---|---|
| 487892 | 12/1929 | Fed. Rep. of Germany | 4/251 |
| 1011871 | 7/1952 | France | 4/251 |

*Primary Examiner*—Charles E. Phillips
*Attorney, Agent, or Firm*—Roger A. Marrs

[57] ABSTRACT

A seat-lifting apparatus is disclosed herein having an anchor attachment secured to the underside of a hinged seat and operably connected to a foot actuator pedal via a pivotal linkage for lifting the seat at the will of the user. An L-shaped base is included pivotally carrying the pedal at one end while pivotally carrying the pedal at one end while pivotally supporting the linkage at its other end. The linkage includes a main link pivoted between its opposite ends to the base and the main link pivoted to the anchor attachment on one end while coupled at its other end to the foot pedal by end-to-end links. The base and the pedal include anti-skid elements to prevent slippage during use.

1 Claim, 1 Drawing Sheet

SEAT LIFT

BACKGROUND OF THE INVENTION

1. Field of the Invention

The present invention relates to sanitary devices and more particularly to a novel seat-raising apparatus carried on the underside of a pivotal toilet seat so that the user may readily automatically raise the seat without using hands and without touching the seat itself.

2. Brief Description of the Prior Art

It has been the conventional practice to raise and lower toilet seats by manually grasping the seat edge and manually lifting or lowering the seat accordingly. The seat is generally hinged at its rear edge to a bowl so that the seat can te rotated about the hinge pins from a usable position on top of the toilet bowl itself and a storage position against the toilet tank where it is kept in a substantially vertical position.

Some attempts have been made to provide lifting means for such seats that employ complicated linkages and mechanisms so that the seat may be moved between either the up or down position. Conventionally, a user intending to avoid touching of the seat, will use his feet, loose sticks or the like in order to raise or lower the seat. Obviously, problems have been encountered when employing such conventional seat-raising means since the conventional pivoting levers and linkages are expensive and difficult to install. Using a person's shoe or stick is extremely rudimentary and is not always successful in raising or lowering the seat in a convenient manner and one which will not break or damage the seat.

Therefore, a long-standing need has existed to provide a novel means for raising a toilet seat which will neither damage the seat nor utilize expensive parts, complicated levers or linkages, and particularly, to provide a means for raising and lowering the seat which is sanitary and convenient for handicapped persons to use.

SUMMARY OF THE INVENTION

Accordingly, the above problems and difficulties are obviated by the present invention which provides a novel means for raising and lower a seat hingeably mounted on a toilet, which includes a base having an upright post or stanchion at one end which pivotally mounts a main lever arm substantially midway between its opposite ends. An anchor attachment is secured to the underside of the seat and a foot pedal is pivotally mounted at one end to the base. A plurality of linkages are pivotally connected between the anchor and the foot pedal via the main lever arm so that the pedal is normally biased to an elevated position. Depression of the pedal towards the base activates the linkage mechanism to raise the seat to an angular position with respect to the bowl so that upon release of the pedal, the seat will reverse and close on the bowl. In one form of the invention, the linkage comprises a rigid link between the anchor attachment and one end of the main lever arm while a rigid link element couples the opposite end of the main lever arm with the end of the pedal opposite to its end pivotally carried on the base. Anti-friction means are provided on the pedal as well as the underside of the base to prevent slipping.

Therefore, it is among the primary objects of the present invention to provide a novel seat-raising apparatus having means for elevating the seat through a foot control and a plurality of pivotal linkages.

Another object of the present invention is to provide a novel seat-raising and lowering device which provides a sanitary means for raising the seat so that the user does not have to use his hands during the elevating procedure for positioning the seat up or down.

Still another object of the present invention is to provide a novel seat-raising and lowering means which may be integrally fixed or carried on the seat itself or which may be detachably connected thereto so that the seat may be raised and lowered by foot operation and control via pivotal linkages.

Yet another object of the present invention is to provide a novel seat-raising device which includes a stationary base having a pivoted foot pedal connected to the seat via link elements which are coupled together in pivotal relationship so that seat-raising is in response to depression of the pedal.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
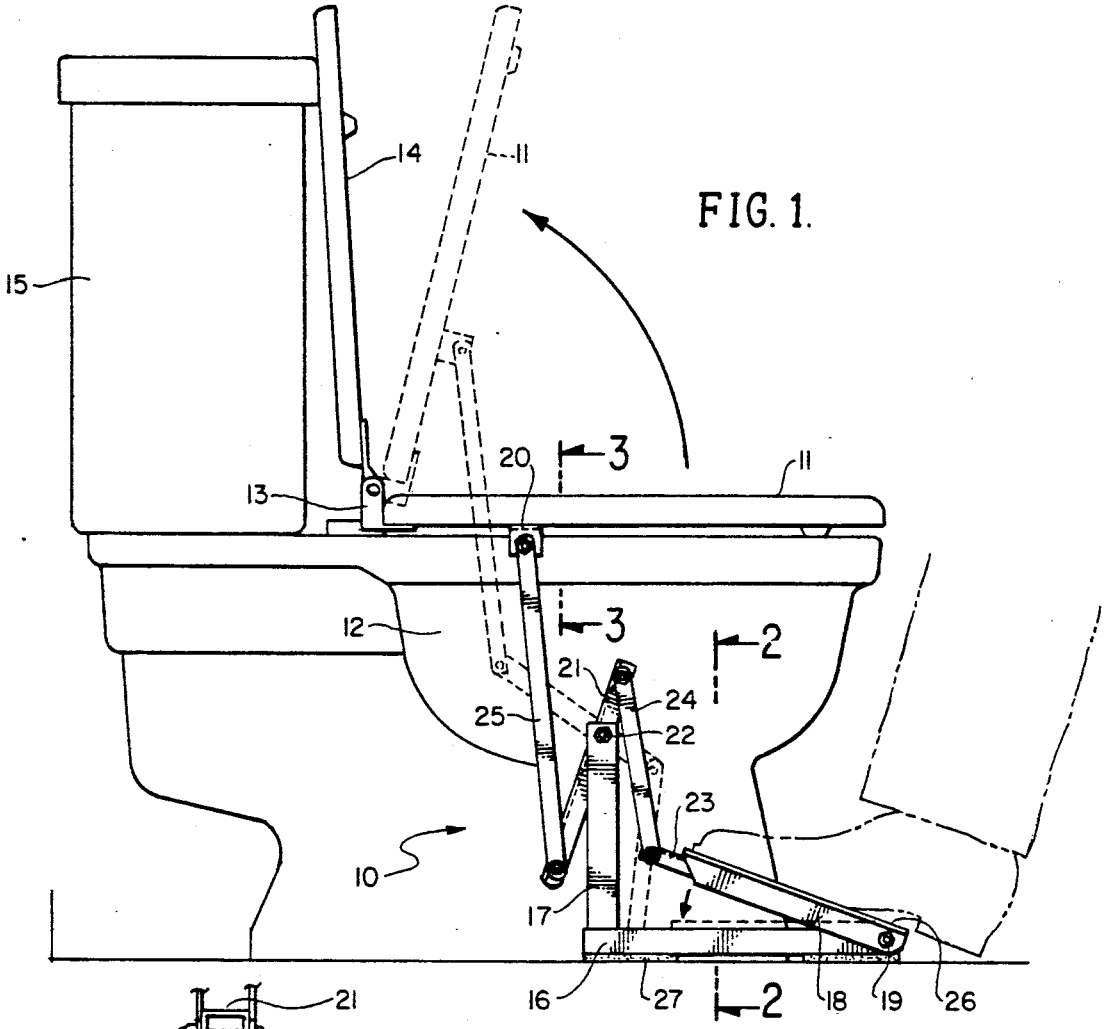
FIG. 1 is a side elevational view showing the novel seat-raising apparatus of the present invention installed in connection with a toilet seat pivotally carried on a toilet bowl.

Referring to FIG. 1, the novel seat-raising apparatus of the present invention is indicated in the general direction of arrow 10 which is employed in connection with a seat 11 pivotally attached to a fixed bowl 12 by means of a hinge 13 carried at the top of the bowl and to the rear thereof. The seat 11 may also be employed in combination with a lid 14 which is illustrated in its open condition resting against a tank 15. As illustrated in solid lines, the lid is in its down position resting on the bowl 12, while the seat is in its raised position as shown in broken lines. It is intended that the seat be not fully raised so that when pressure is released from the raising position, gravity will cause the seat to lower to the solid line position. Therefore, the seat-raising apparatus of the present invention is useful for raising the seat and/or lowering the seat by means of foot control.

The seat-raising apparatus 10 includes an elongated base 16 having an upright post or stanchion 17 carried at one end thereof. An operating foot pedal 18 is pivoted at one end to the end cf the base opposite to its end carrying the upright post 17 and the pivot connection is indicated by numeral 19. The apparatus further includes an anchor means 20 carried on the underside of the seat 11 along one edge thereof in fixed spaced relationship with respect to the hinge 13. The anchor means 20 and the pedal 18 are connected together by a linkage assembly so that depression of the pedal 18 is translated into upward movement of the seat 11 so as to pivot about hinge 13 to the dotted lined position.

The linkage assembly includes a main link arm 21 pivoted to the upper end of the stanchion 17 by pivot connection 22 which is disposed midway between the opposite ends of the arm 21. One end of arm 21 is pivotally connected to an element 23 carried on the end of pedal 18 by means of a link 24, while the opposite end of arm 21 is pivotally connected to the anchor means 20 by an elongated link 25. Therefore, it can be seen that the links and arms of the linkage assembly are connected in an end-to-end relationship by means of pivots and that the assembly is pivotally carried on the upper end of the stanchion 17 by pivot 22. Therefore, when the pedal is depressed from its solid-line position to its broken line position, the linkage assembly will be repositioned from its solid-line position to the broken-line illustration to raise the seat 11.

Figure 2:
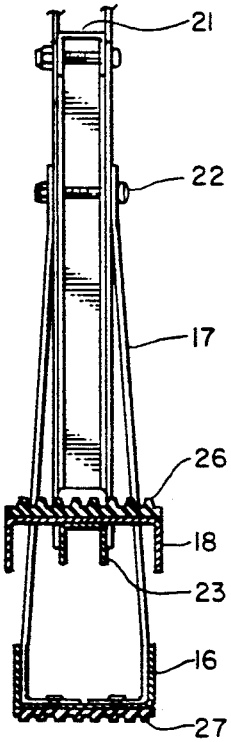
FIG. 2 is .a transverse cross-sectional view of the seat-raising apparatus shown in FIG. 1 as taken in the direction of arrows 2—2 thereof.

It is to be understood that the pedal 18 includes a strip of corrugated or ribbed anti-friction material, indicated by numeral 26, while the underside of the base 16 is provided with the same anti-friction material as identified by numeral 27. This material will prevent slippage of the user's foot on the pedal, as well as slippage of the base on the floor or ground platform. FIG. 2 more clearly shows the anti-friction means 26 and 27.

Figure 3:
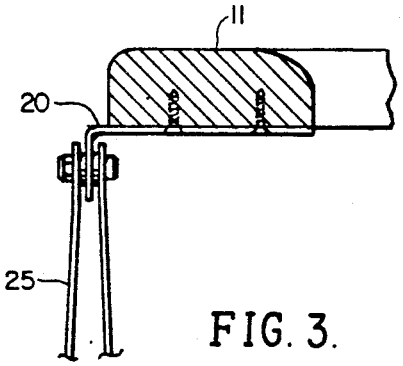
FIG. 3 is a transverse cross-sectional view of the anchor means used in the seat-raising apparatus of FIG. 1 taken in the direction of arrows 3—3 thereof.

Referring now in detail to FIGS. 2 and 3, it is to be understood that the links may be of separate pieces of corrugated or specially coated flat material, or, if desired, the links may be composed of a U-shaped channel material which is either coated or painted to prevent rust or deterioration of the finish. For example, as shown in FIG. 3, link 25 may be composed of two separate pieces which are joined at their opposite ends by the pivots to the anchor means 20 and the end of arm 21 respectively, or, if desired, the link may be composed of a single U-shaped channel. Such a channel is indicated by numeral 21 for the lever arm. Also, the anchor means 20 may be permanently attached to the underside of the seat by screws or other fasteners, or, if desired, a clip or other type of detachable connection may be made for easier installation.

In view of the foregoing, it can be seen that the lifting apparatus of the present invention provides a convenient and reliable control for elevating the seat above the bowl to an angular position so that upon controlled release of the pedal, the seat can be lowered to its original position. The links are composed of rigid materials of sufficient strength to carry the load forces necessary to support the weight and to push the seat to the upper position. If desired, the seat may be elevated all the way rearward against the lid 14 so that access may be had to the bowl for cleaning and maintenance purposes. However, it is the primary purpose of the invention for the seat to be merely raised to the angular position so that it may be lowered by the use of gravitational forces under the control of the foot pedal 18.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A toilet seat lifter comprising the combination of:

a toilet bowl having a seat with a hinge on the rear side thereof, permitting said seat to pivot between an at-rest position on said bowl and a raised position above said bowl;

said seat hinge critically located at the rear of said seat and at the rear of said bowl;

an anchor carried on said seat in fixed spaced-apart relationship with respect to said hinge of said hinged seat and critically disposed forward of said rear hinge location;

a base having opposite ends with an upright stanchion secured to one selected end of said base and said stanchion extending normal to said base with its other end in spaced relationship to said base;

a foot pedal pivotally attached to the base at the end of said base opposite from said selected end supporting said upright stanchion;

a linkage assembly pivotally carried on said upright stanchion having its opposite ends pivotally coupled to said foot pedal and said anchor means respectively;

said linkage assembly includes a main link arm having a pivot midway between its opposite ends connected to said other end of said upright stanchion;

said linkage assembly further including an elongated link pivotally connected at its opposite ends to one end of said main link arm and to said anchor on its other end;

a link element pivoted at its opposite ends to the other end of said main link arm and said foot pedal end opposite from the end attached to said base;

said foot pedal and said base includes anti-slip means comprising a plurality of parallel spaced-apart ribs composed of a friction material;

said link assembly composed of channel stock.

* * * * *